US006495778B2

(12) United States Patent
Barrat et al.

(10) Patent No.: US 6,495,778 B2
(45) Date of Patent: Dec. 17, 2002

(54) BREAKABLE ELECTRIC CONTACT DEVICE

(75) Inventors: Sylvain Barrat, Belleville sur Saone (FR); Arsene Schmidt, Saint Cyr au Mont d'Or (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/874,243

(22) Filed: Jun. 6, 2001

(65) Prior Publication Data

US 2002/0058438 A1 May 16, 2002

(30) Foreign Application Priority Data

Jun. 6, 2000 (FR) ..... 00.07242

(51) Int. Cl.[7] ..... H01H 1/60
(52) U.S. Cl. ..... 200/253; 200/252
(58) Field of Search ..... 200/238–242, 200/252, 253, 254, 253.1, 244, 306, 554; 439/188

(56) References Cited

U.S. PATENT DOCUMENTS 4,490,595 A * 12/1984 Meinherz et al. ..... 200/254
5,013,876 A * 5/1991 Chabala ..... 200/252
5,693,924 A 12/1997 Fetterolf, Sr. et al.
6,091,038 A * 7/2000 Murphy et al. ..... 200/253

FOREIGN PATENT DOCUMENTS

| | | |
|---|---|---|
| DE | 946 362 C | 8/1956 |
| EP | 0 890 969 A2 | 1/1999 |
| FR | 2 082 431 A | 12/1971 |

* cited by examiner

*Primary Examiner*—Elvin Enad
*Assistant Examiner*—M. Fishman
(74) *Attorney, Agent, or Firm*—Oliff & Berridge, PLC

(57) ABSTRACT

Breakable electric contact device of the type comprising two conducting strips (3, 4) between which an electric contact can be made using a conducting piece (5) in the form of a moving blade, at least one of the faces of which is intended to come into contact with the conducting strips. Furthermore the device comprises two cleaning strips (7, 8) which, located in front of the conducting strips (3, 4) in the direction of travel of the moving blade (5) toward the contact-closed position, are intended to scrape at least the region of each face of the moving blade (5) that is intended to press against a conducting strip (3, 4).

13 Claims, 2 Drawing Sheets

BREAKABLE ELECTRIC CONTACT DEVICE

The subject of the present invention is a breakable electric contact device which can be fitted in particular into a junction block.

BACKGROUND

Certain electric contacts may be installed in environments where there is contamination of various kinds. This may be metallurgical contamination resulting in oxidation of the contacts as a result of a corrosive environment, or contamination with dust. What this means is that when the contacts are contaminated, there is a lack of reliability of the electrical connection when the electric contact is closed. The contacts involved may consist, for example, of conducting strips in the form of stirrups, associated with a conducting piece in the shape of a moving blade intended to become introduced, by pivoting, between the two stirrups in order to close the contact.

SUMMARY OF THE INVENTION

The object of the invention is to provide a breakable electric contact device, in which the reliability of the electric contact is ensured, without the need for special maintenance, even if the installation is in a contaminating environment.

To this end, the device to which it relates, of the type comprising two conducting strips between which an electric contact can be made using a conducting piece in the form of a moving blade, at least one of the faces of which is intended to come into contact with the conducting strips, is characterized in that it comprises two cleaning strips which, located in front of the conducting strips in the direction of travel of the moving blade toward the contact-closed position, are intended to scrape at least the region of each face or the moving blade that is intended to press against a conducting strip.

Thus, the conducting piece coming into contact with the cleaning strips before closing the electric contact is rid of all traces of oxidation or dust in its regions of contact with the conducting strips.

Advantageously and so as to allow adequate pressure to be exerted in order to scrape the conducting piece, each cleaning strip is made of a rigid and elastic material.

When the conducting strips are in the shape of stirrups, each cleaning strip associated with a stirrup has a slot delimited by two sharp edges intended to scrape the two faces of the moving blade.

According to one embodiment, when the moving blade is mounted so that it pivots about an axis transversal to the openings of the stirrups and offset laterally with respect to the two stirrups, the two cleaning strips associated with the two stirrups are parallel to these stirrups and arranged on the side of each stirrup furthest from the axis of pivoting of the moving blade.

As the cleaning strips play no part in the electrical connection, it is of little importance whether or not the material of which they are made is conducting.

According to a first option, each cleaning strip is independent of the corresponding stirrup and pressed against the latter.

According to another option, each cleaning strip consists of the actual constituent part of the stirrup which is bent back on itself.

In order to clean adequately the regions of the moving blade which are to come into contact with the contact strips, each cleaning strip protrudes from the corresponding stirrup on the entry side thereof, the cleaning strip furthest from the axis of rotation of the moving blade protruding more than the cleaning strip closest to this axis. The offset of each strip with respect to the corresponding stirrup depends on the radius of pivoting of the moving blade.

According to another embodiment of this device, when the moving blade is mounted so that it can be moved in terms of translation between the position in which the electric contact is open and the position in which it is closed, each cleaning strip is situated forward in the direction of travel of the moving blade and aligned, in the direction of travel of the moving blade, with the region of contact between the moving blade and a conducting strip.

BRIEF DESCRIPTION OF THE DRAWINGS

In any case, the invention will be clearly understood with the aid of the description which follows, with reference to the appended schematic drawing which, by way of nonlimiting examples, depicts a number of embodiments of this device.

DETAILED DESCRIPTION OF EMBODIMENTS

Figure 1:
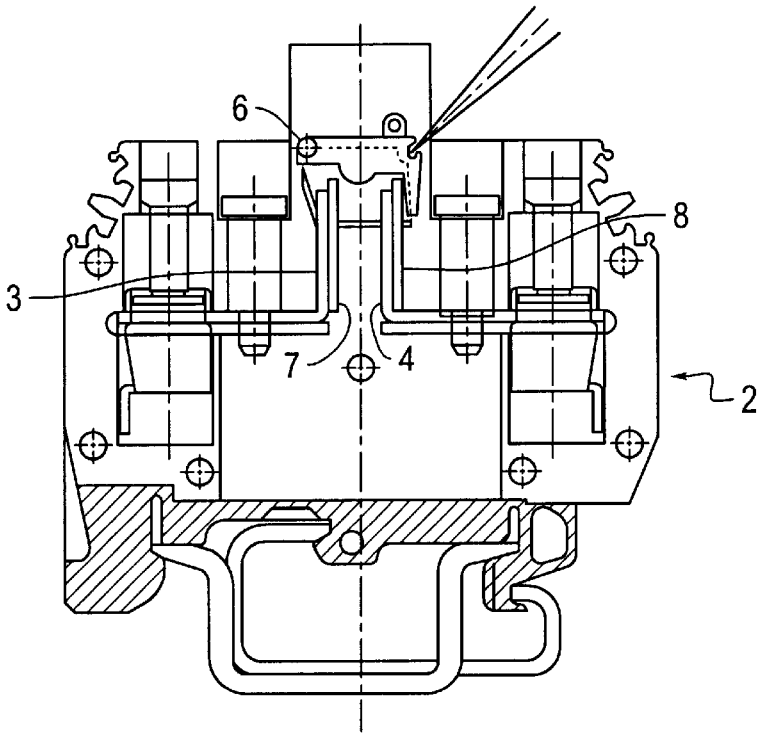
FIG. 1 is a general view of a junction block equipped with the contact device according to the invention.
Figure 2:
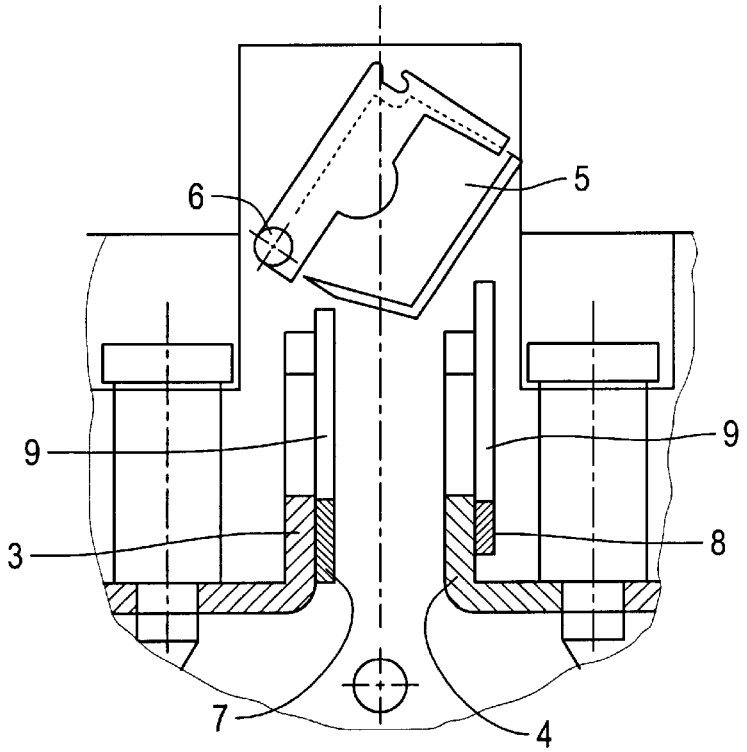
FIG. 2 is a view on a larger scale of the breakable contact device of the block of FIG. 1, FIGS. 3 and 4 depict two embodiments of a contact strip and of the associated cleaning strip.

FIG. 1 depicts a junction block 2 comprising two conducting strips 3 and 4 respectively, each in the form of stirrups, parallel to one another, between which an electrical connection can be made via a moving conducting blade 5. The conducting blade 5 is mounted so that it can pivot about an axis 6 directed transversely with respect to the openings of the stirrups, and offset laterally with respect to the two stirrups.

Figure 3:
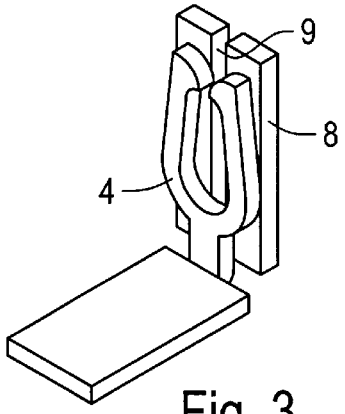

Two cleaning strips, 7 and 8 respectively, are associated with the two conducting strips 3 and 4. FIG. 3 shows the strip 8 in greater detail. This strip 8 is pressed up against the stirrup 4 and has a slot 9 delimited by two sharp edges intended to scrape the two faces of the moving blade 5 before this blade enters the stirrup 4. As shown in the drawing, the cleaning strips 7, 8 are arranged on the side of each stirrup, 3 or 4 respectively, furthest from the axis of pivoting of the moving blade 6, and each cleaning strip 7, 8 protrudes beyond the corresponding stirrup 3, 4 on the entry side thereof. It is visible in the drawing that the cleaning strip 8 furthest from the axis 6 of rotation of the moving blade protrudes further from the stirrup 4 than the cleaning strip 7 does with respect to the stirrup 3. This is explained by the fact that the cleaning strip 7 is closer to the axis 6 of rotation of the moving blade 5 than the cleaning strip 8.

Each cleaning strip 7, 8 is made of a material which is rigid but elastic enough to exert pressure against the two large faces of the moving blade, as the latter moves. In the embodiment depicted in FIG. 3, the cleaning strip 8 is distinct from the stirrup 4 and pressed against it.

Figure 4:
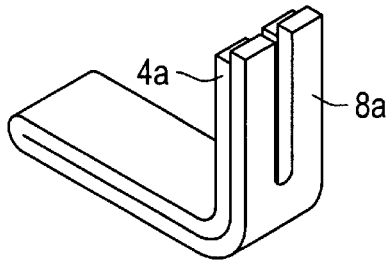

In an alternative form depicted in FIG. 4, the cleaning strip 8*a* is made of the same piece as the stirrup 4*a*, this piece being folded back on itself to form both the stirrup 4*a* and the cleaning strip 8*a*.

Figure 5:
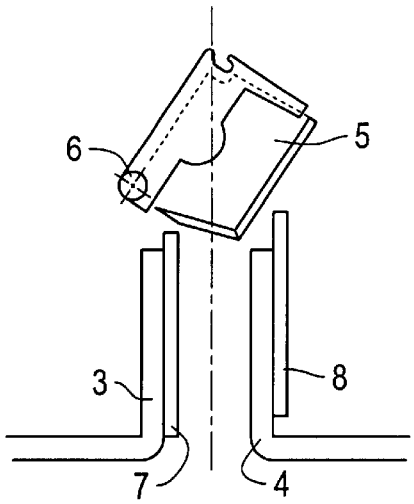
FIGS. 5 to 7 are three views illustrating the path of a moving conducting blade between the position in which the contact device is open and its closed position.
Figure 6:
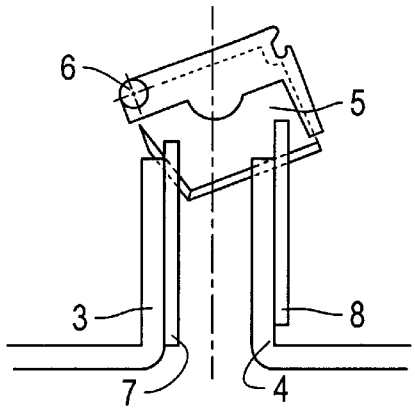
Figure 7:
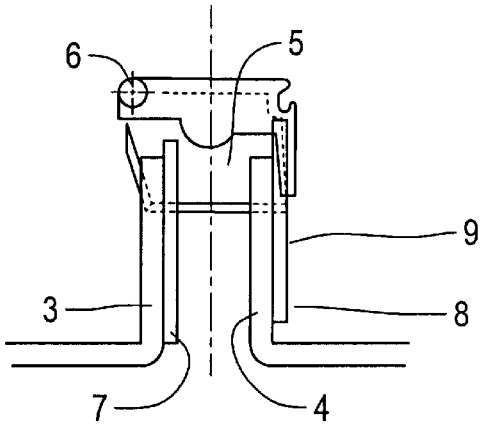

FIGS. 5 to 7 illustrate the method of cleaning the moving conducting blade 5 between the position in which the contact is open, which position is depicted in FIG. 5, and its closed position which is depicted in FIG. 7. It is clearly apparent from these figures that, prior to the closure of the contact via the engaging of the blade between the branches of the two stirrups 3 and 4, the regions of the blade which have to penetrate between the two stirrups rub between the sharp edges of the slots 9 of the cleaning strips 7 and 8, which removes any trace of oxidation or dust from the regions of contact.

Figure 8:
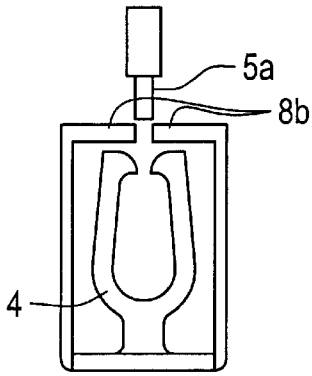
FIG. 8 is a schematic view of another embodiment in which the moving contact piece can move in terms of translation.

FIG. 8 depicts an alternative form of embodiment in which contact is made by a part 5*a* that can move only in terms of translation and is intended to penetrate between the branches of two stirrups, one, 4, of which is depicted in the drawing. In this case, cleaning strips 8*b* are situated forward in the direction of travel of the moving blade, and aligned in the direction of travel of the moving blade, with the region of contact between the moving blade and the regions of contact between the moving blade and the branches of the stirrup 4.

As is apparent from the foregoing, the invention makes a great improvement to the state of the art by providing a breakable electric contact device of simple structure which is extremely reliable insofar as it allows the conducting piece intended to close the contact to be self-cleaned prior to each closure operation.

What is claimed is:

1. A breakable electric contact device, comprising:

two conducting strips;

a moving blade having two faces to correspondingly contact the two conducting strips to form an electric contact; and two cleaning strips located in front of the two conducting strips in a direction of travel of the moving blade toward a contact-closed position, each cleaning strip to scrape at least a contact region of each face of the moving blade that presses against a corresponding conducting strip.

2. The device according to claim 1, each said cleaning strip is made of a rigid and elastic material.

3. The device according to claim 1, wherein the two conducting strips are two stirrups, each said cleaning strip is associated with a corresponding stirrup of the two stirrups and has a slot delimited by two sharp edges to scrape the two faces of the moving blade.

4. The device according to claim 3, wherein the moving blade is mounted to pivot about an axis transversal to openings of the two stirrups and offset laterally with respect to the two stirrups, the two cleaning strips are parallel to the two stirrups, and each said cleaning strip is arranged on a side of the corresponding stirrup farthest from the axis.

5. The device according to claim 4, wherein each said cleaning strip is independent of the corresponding stirrup and pressed against the corresponding stirrup.

6. The device according to claim 4, wherein each said cleaning strip comprises a part of the corresponding stirrup which is bent back on itself.

7. The device according to claim 4, wherein each said cleaning strip protrudes from the corresponding stirrup on an entry side thereof, a far cleaning strip farthest from the axis protruding more than a near cleaning strip closest to the axis.

8. The device according to claim 1, wherein the moving blade is mounted to translate between a first position in which the electric contact is open and a second position in which the electric contact is closed, each said cleaning strip is situated forward in a direction of travel of the moving blade and aligned, in the direction of travel of the moving blade, with the contact region.

9. The device according to claim 2, wherein the two conducting strips are stirrups, each said cleaning strip is associated with a corresponding stirrup of the two stirrups and has a slot delimited by two sharp edges to scrape the two faces of the moving blade.

10. The device according to claim 5, wherein each said cleaning strip protrudes from the corresponding stirrup on an entry side thereof, a far cleaning strip farthest from the axis protruding more than a near cleaning strip closest to the axis.

11. The device according to claim 6, wherein each said cleaning strip protrudes from the corresponding stirrup on the entry side thereof, a far cleaning strip farthest from the axis protruding more than a near cleaning strip closest to the axis.

12. The device according to claim 2, wherein the moving blade is mounted to translate between a first position in which the electric contact is open and a second position in which the electric contact is closed, each said cleaning strip is situated forward in a direction of travel of the moving blade and aligned, in the direction of travel of the moving blade, with the contact region.

13. The device according to claim 3, wherein the moving blade is mounted to translate between a first position in which the electric contact is open and a second position in which the electric contact is closed, each said cleaning strip is situated forward in a direction of travel of the moving blade and aligned, in the direction of travel of the moving blade, with the contact region.

* * * * *